US010576325B2

(12) United States Patent
Tedesco

(10) Patent No.: US 10,576,325 B2
(45) Date of Patent: Mar. 3, 2020

(54) WEARABLE RESISTANCE TRAINING DEVICE

(71) Applicant: 1109 Bravo L.L.C., Louisville, KY (US)

(72) Inventor: Christopher L. Tedesco, Louisville, KY (US)

(73) Assignee: 1109 BRAVO L.L.C., Louisville, KY (US)

( * ) Notice: Subject to any disclaimer, the term of this patent is extended or adjusted under 35 U.S.C. 154(b) by 150 days.

(21) Appl. No.: 15/656,836

(22) Filed: Jul. 21, 2017

(65) Prior Publication Data

US 2019/0022452 A1 Jan. 24, 2019

(51) Int. Cl.

| | |
|---|---|
| ***A63B 21/00*** | (2006.01) |
| ***A63B 24/00*** | (2006.01) |
| ***A41D 1/04*** | (2006.01) |

(52) U.S. Cl.

CPC ..... *A63B 21/153* (2013.01); *A41D 1/04* (2013.01); *A63B 21/154* (2013.01); *A63B 21/4007* (2015.10); *A63B 21/4025* (2015.10); *A63B 24/0087* (2013.01); *A63B 24/0062* (2013.01); *A63B 2024/0093* (2013.01); *A63B 2220/12* (2013.01); *A63B 2220/17* (2013.01); *A63B 2220/54* (2013.01); *A63B 2220/807* (2013.01); *A63B 2220/836* (2013.01)

(58) Field of Classification Search

CPC ..... A63B 21/153; A63B 21/0442; A63B 21/0552; A63B 21/4025; A63B 21/4007; A63B 24/0087; A63B 21/154; A63B 2230/50; A63B 2230/062; A63B 2220/836; A63B 2220/17; A63B 2220/12; A63B 2220/54; A63B 2024/0093; A63B 24/0062; A63B 2220/807; A63B 21/4001–4025; A41D 1/04

See application file for complete search history.

(56) References Cited

U.S. PATENT DOCUMENTS 4,961,573 A * 10/1990 Wehrell ..... A63B 21/0552 482/124

5,234,395 A * 8/1993 Miller ..... A63B 21/018 482/114

(Continued)

OTHER PUBLICATIONS

International Search Report and Written Opinion issued in Application No. PCT/US2018/043138 dated Nov. 7, 2018.

*Primary Examiner* — Andrew S Lo

(74) *Attorney, Agent, or Firm* — Middleton Reutlinger

(57) ABSTRACT

The described embodiments relate to systems, methods, and apparatuses for providing linear tension to multiple areas of a person to improve training and exercise. The tension can be applied by cables supplied from cable spools that are attached within a resistance assembly. The resistance assembly can be worn as a backpack during exercises, thereby providing a portable means through which tension can be provided to the body. The cables from the resistance assembly can be attached to appendages such as the wrists and legs of the person, and the tension provided by the cables can be adjustable. For instance, the tension can be made non-uniform across the body in order to improve the person's ability to maneuver in situations where there is an imbalance of force on the body.

11 Claims, 5 Drawing Sheets

(56) References Cited

U.S. PATENT DOCUMENTS 5,328,432 A * 7/1994 Gvoich ..... A63B 21/018 482/114
5,358,461 A * 10/1994 Bailey, Jr. ..... A63B 21/0053 290/1 R
5,618,249 A * 4/1997 Marshall ..... A63B 21/153 482/115
5,792,034 A * 8/1998 Kozlovsky ..... A63B 21/0004 482/124
6,099,447 A * 8/2000 Ramsaroop ..... A63B 21/153 482/107
6,280,365 B1 * 8/2001 Weber ..... A63B 21/018 482/124
6,659,921 B2 * 12/2003 Vernon ..... A63B 21/0442 482/114
7,147,590 B2 * 12/2006 Toven ..... A63B 69/0028 482/51
7,297,090 B2 * 11/2007 Torres ..... A63B 21/015 482/124
7,563,212 B2 * 7/2009 Smith ..... A63B 21/025 482/124
7,850,583 B2 * 12/2010 Smith ..... A63B 21/025 482/124
7,854,694 B1 * 12/2010 Frunzi ..... A63B 21/0552 482/121
8,323,127 B2 * 12/2012 Webb ..... A63B 69/0002 473/422
8,926,480 B2 1/2015 Lyszczarz
8,979,709 B2 3/2015 Toback et al.
9,345,942 B2 * 5/2016 Stevens ..... A45F 3/04
9,409,501 B2 * 8/2016 Henry ..... A63B 21/00069
D797,868 S * 9/2017 Thomas ..... A63B 21/023 D21/683
9,795,818 B2 * 10/2017 Powell ..... A63B 21/0442
2004/0053755 A1 * 3/2004 Wilkinson ..... A63B 21/153 482/124
2005/0221965 A1 * 10/2005 Boland ..... A63B 21/0004 482/121
2005/0282689 A1 * 12/2005 Weinstein ..... A63B 21/0552 482/124
2006/0229173 A1 * 10/2006 Foley ..... A63B 21/06 482/105
2007/0219074 A1 * 9/2007 Pride ..... A63B 21/023 482/124
2009/0062087 A1 3/2009 Poppinga
2010/0292051 A1 * 11/2010 Benumof ..... A61H 1/0296 482/10
2011/0111890 A1 * 5/2011 Webb ..... A63B 69/0002 473/458
2011/0183819 A1 * 7/2011 Pharoe ..... A63B 21/0552 482/105
2012/0322635 A1 * 12/2012 Carter ..... A63B 21/0442 482/129
2013/0324366 A1 12/2013 Pride
2014/0357457 A1 * 12/2014 Boekema ..... A63B 21/00069 482/124
2015/0011368 A1 * 1/2015 Manor ..... A63B 21/0051 482/116
2015/0328520 A1 * 11/2015 Barnes ..... A63B 21/00185 482/56
2016/0008655 A1 1/2016 Martin
2016/0074699 A1 * 3/2016 Walter ..... A63B 21/00185 482/129
2016/0206912 A1 7/2016 Carriere, Jr.
2017/0100626 A1 * 4/2017 Ko ..... A63B 21/4009
2018/0021624 A1 * 1/2018 Cordero ..... A63B 23/12 601/48

* cited by examiner

WEARABLE RESISTANCE TRAINING DEVICE

TECHNICAL FIELD

The embodiments described herein generally relate to wearable resistance devices. Specifically, the embodiments relate to systems, methods, and apparatuses for providing tension to different appendages of a person using a wearable resistance device.

BACKGROUND

Exercise devices typically encourage users to work out in a static environment to reduce the risk of injury. However, some professions may require that a person train in a variety of environments in order to prepare for unpredictable situations. Such professions can include the military, where trainees may be forced to exert themselves in a variety of environments. Therefore, by training with a device that is not meant to travel, or otherwise be used in different environments, such trainees may not be adequately prepared to maneuver under unpredictable conditions. Other professions where the combination of mobility and resistance can be beneficial include professional athletics, law enforcement, and function specific rehabilitation. Essentially, any profession or avocation where enhanced physical ability can equate to higher performance or lower incidence of injury. Furthermore, by only training under a limited number of conditions, risk of injury can increase because the trainee may not have the muscle memory or brain plasticity to adapt to unpredictable situations.

SUMMARY

The described embodiments relate to systems, methods, and apparatuses for providing tension to multiple areas of a person to improve training, exercise, therapy or rehabilitation.

In some implementations, a method performed by one or more processors is set forth as including steps such as receiving, from one or more sensors, data related to a motion of a user that is wearing a resistance assembly. The one or more sensors can include a pedometer, camera, position sensor, torque sensor, GPS device, and/or any other sensor that can be attached to a user. The data can correspond to the motion of appendages of the user. The steps can further include, determining, based on the data, a metric that is associated with a performance of the user, and causing a tension or a resistance of one or more cables of the resistance assembly to increase or decrease based on the metric. For instance, in response to the metric reaching a predetermined threshold, a computing device can control an actuator or other electromechanical device to increase or decrease tension at the one or more cables.

In other implementations, a wearable apparatus is set forth as including a first plate that includes joints that extend from a surface of the first plate, and a mount that includes cable pathways and at least two pipes extending from the mount. The wearable apparatus can further include cable spools that each rotate around each joint and provide cable that extends through the cable pathways and the at least two pipes, and a second plate that is connected to the joints and extends over the first plate and the cable spools. The at least two pipes can direct the cables in different directions to provide separate amounts of tension to appendages of a user to whom the cables are connectable. The mount can extend from a first end of the first plate, and the wearable apparatus can further include a clip that extends from a second end of the first plate over a bottom surface of the first plate. Each joint can include a rod that extends from the surface of the first plate, and the clip can extend from the first plate away from each joint. The cable spools can be configured to provide an adjustable amount of tension to the cables. The cables spools can include a first cable spool and a second cable spool, the first cable spool being connected to a first joint located at a first corner of the first plate, and the second cable spool being connected to a second joint located at a second corner of the first plate. Each joint can penetrate an aperture of a cable spool and define an axis of rotation for the cable spool. The wearable apparatus can include a sensor configured to provide signals according a performance of a user to which the cable is connected. Additionally, the wearable apparatus can include a computing device connected to the sensor and configured to dynamically cause changes in tension to the cable based on the performance of the user as indicated by the signals.

In yet other implementations, a method for providing a wearable apparatus is set forth. The method can include attaching a cable spool to a joint of a first plate, the first plate including a pipe mount with a cable pathway. The steps can further include connecting a pipe to the pipe mount such that the pipe extends away from the first plate and the joint, and directing cable from the cable spool through the cable pathway of the pipe mount and the pipe. The steps can also include connecting a second plate to the joint of the first plate to retain the cable spool between the first plate and the second plate. The joint can extend through an aperture of the cable spool and provide an axis of rotation for the cable spool. The steps can further include connecting multiple pipes to the pipe mount, the multiple pipes extending from the pipe mount in different directions. The pipe mount can include multiple cable pathways, and each cable pathway can include an opening located at a surface of the pipe mount. The cable spool can be configured to provide an amount of tension on the cable in a direction that pulls the cable back through the pipe. The second plate can extend over the cable spool and the cable.

In yet other implementations, a system is set forth as including a plate that includes a pipe mount from which a pipe extends, and a cable pathway through which a cable passes. The system can further include a cable spool that supplies the cable that passes from the cable spool through the pipe mount and the pipe, and a pulley for redirecting a cable from the pipe in a trajectory that is different than a direction in which the pipe extends. The system can also include a strap that supports the plate when the strap is worn by a user. The pulley and the cable can be configured to attach at separate locations on the user to create tension at the separate locations. The system can further include a separate plate that at least partially extends over the cable spool and the cable. The cable spool can be configured to provide an adjustable amount of tension to the separate locations on the user. An opening of the pipe can face away from the plate and towards the pulley. The plate can further include a clip that extends over a side of the plate that opposes the cable spool. The system can also include multiple cable spools configured to provide multiple cables through the pipe mount. Each of the multiple cables spools can include separately adjustable tension, and a vest configured to be worn by the user and support the multiple cable spools and the plate.

DETAILED DESCRIPTION OF THE INVENTION

Figure 1:
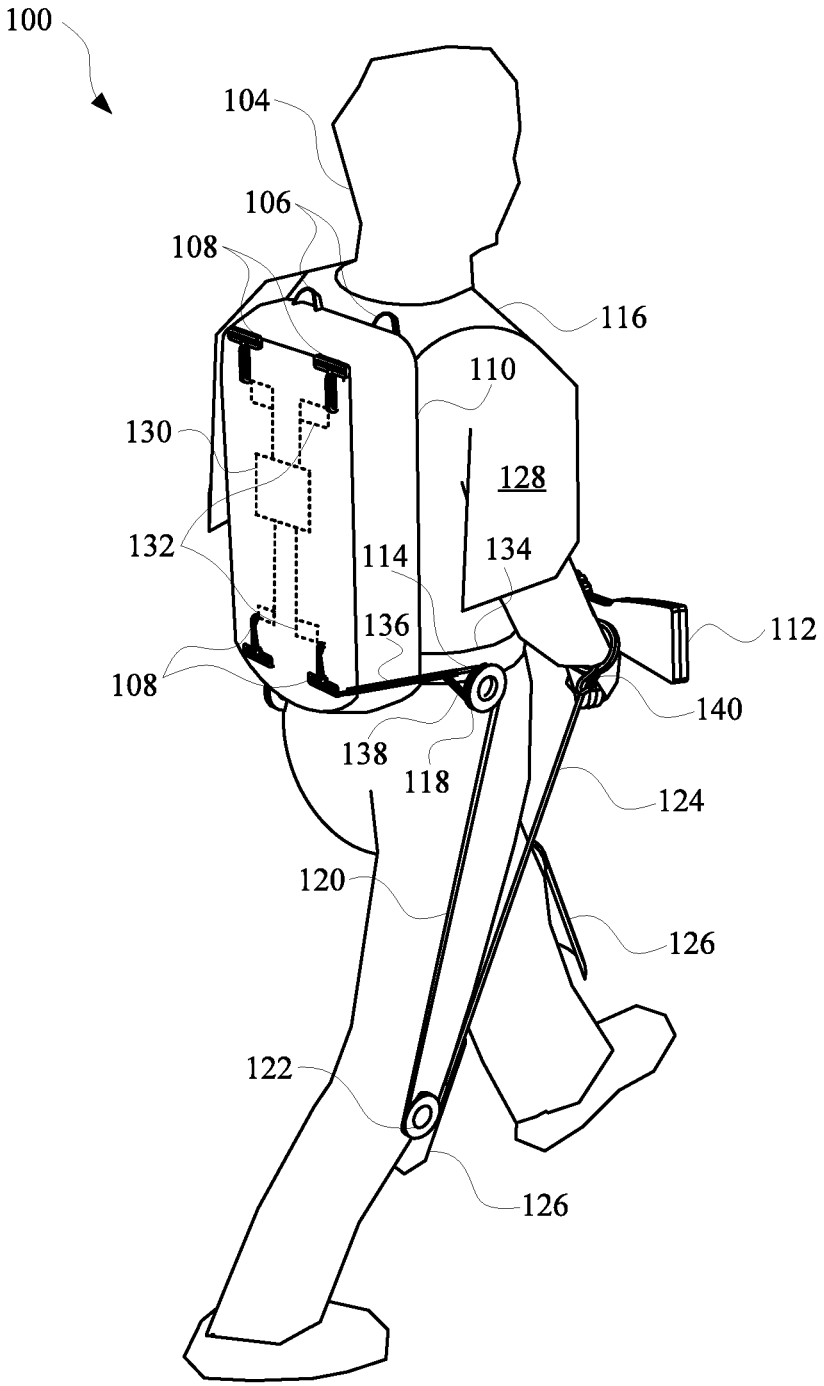
FIG. 1 illustrates a perspective view of a user wearing an implementation of the body mounted device discussed herein.

The described embodiments relate to systems, methods, and apparatuses for using a body mounted device to apply physical resistance to a user during training or therapy. Strenuous occupations such as military service can typically require physical training. Current training methods can include repetitive tactical drills and resistance training, which can include significant risk of injury. Furthermore, current resistance training devices are often stationary, being attached to a floor or wall, thereby offering no mobility for trainees that typically perform mobility exercises. Moreover, group exercises are not typically possible with stationary training devices, thereby limiting the ability to simulate real-world scenarios where multiple persons are involved.

The body mounted device discussed herein allows for special mobility and adjustable resistance during training, thereby allowing for a variety of tactical and group activities to be undertaken. The body mounted device can include a backpack, bodysuit, waistband, belt, elbow band, knee band, wristband, arm band, leg band, and/or any other wearable resistance device or combination of resistance devices. The body mounted device allows for a range of movements and patterns of motion, and is adjustable for multiple different body sizes.

The body mounted device can use tethers to attach to portions of the body to allow for unrestricted motion with intentional resistance while performing therapeutic and/or occupational related movements during training. For instance, resistance at the arm can improve motion stability and draw speed during simulations involving weapons training. In some instances, the body mounted device can include sensors, such as an accelerometer capable of detecting motion in three dimensions. The sensors can track various different metrics that can be presented to the user, so that the user will be able to tell how they are improving and make adjustments to the body mounted device to continue making progress.

The body mounted device can include a wearable base portion, which can be a common location for cables or cords to attach from other wearable accessories associated with the body mounted device. The cables can be adjusted individually in order to create a balanced or an unbalanced load on a user of the body mounted device. The cables can be attached to anchor points on the wearable base portion of the body mounted device. The cables can be metal cables and can be attached to pulleys, cams, springs, dashpots, elastic bands, and/or any other device that provides mechanical resistance.

By providing unbalanced loading during training, neuroplasticity and proprioception of a user can be increased or otherwise improved. Furthermore, conditional neuroplasticity can also be developed because the body mounted device allows for movement in multiple different environments that stimulate various physiological responses (e.g., smells). The body mounted device can also improve muscle response through isometric, eccentric, and concentric muscle contractions during use of the body mounted device. Additionally, the body mounted device can promote the development of slow twitch and fast twitch (e.g., fast twitch oxidative and fast twitch glycolytic) muscle fibers.

FIG. 1 illustrates a perspective view 100 of a user 104 wearing an implementation of the body mounted device 110 discussed herein. The body mounted device 110 can include multiple different adjustable cables for providing resistance to various portions of the user 104 during training being undertaken by the user 104. The body mounted device 110 can include straps 108 to which each cable portion (114, 120, and 124) can be attached. Each strap 108 can include one or more snaps or locks for connecting to the body mounted device 110 and/or any other features that are internal to the body mounted device 110. Furthermore, the straps 108 can be adjusted to have different dimensions and/or different tensions. For instance, the straps 108 can be adjusted such that the tension on one side of the body of the user 104 is different than the tension on an opposite side of the body of the user 104. In some implementations, the body mounted device 110 can include hooks 106 and each hook 106 can be used to connect the body mounted device 110 to other apparatuses. For example, each hook 106 can be connected to another resistance training apparatus (e.g., a separate cable or wall) in order to provide another source of resistance during training.

In some implementations, the body mounted device 110 can be attached to a vest 116 that is worn by the user 104 during training. The vest 116 can be a Modular Lightweight Load-Carrying Equipment (MOLLE) vest, worn for tactical training and operations. The body mounted device 110 can be attached to the vest 116 via the hooks 106 and/or any other mechanism for attaching clothing to a mounted device. The vest 116 can include multiple locations in which pulleys (e.g., 118 and 122) can be attached. In this way, the resistance can be applied across the vest 116 using cables and pulleys in order for even and uneven tension to be exerted on the user 104 during training. In some implementations, the body mounted device 110 and/or the vest 116 can be attached to belt 134, and the belt can be attached to a pulley 118. The pulley 118 can be a single pulley or a stack of pulleys capable of guiding one or more cables to various locations at or near portions of the body of the user 104. Furthermore, in some implementations, the pulley 118 can be mountable on location that is separate from the body mounted device 110. For instance, the pulley 118 can be mounted on the belt 134 or pants of the user 104, thereby creating an indirect trajectory for the cable portion 114 and the cable portion 120. The indirect trajectory can provide an intentional off-balance or disproportional resistance over the body of the user 104, improving the plasticity, coordination, and bio-mechanical correction of the user 104.

In some implementations, one or more of the cable portions (114, 120, 122) can be surrounded by a cable guide 136, which can be a rigid or flexible guide that can protect the cable during training. The cable guide 136 can be positioned at various angles to improve form and positioning of the trainee. The cable guide 136 can be a pipe made from a metal, alloy, plastic, or other rigid material that also allows the cable to move through the cable guide 136 with minimal friction. In some implementations, the body mounted device 110 can include multiple cable guides 136 that can be located between the body mounted device 110 and pulleys. In other implementations, the body mounted device 110 can include a cable guide 136 between two pulleys, such as pulley 118 and pulley 122. In some implementations, the cable guide 136 can be attached to the pulley 118 by a joint 138, which can be a weld, bracket, and/or any other piece of material that can attach a cable guide to a pulley. In this way, the cable guide 136 can be directed to the pulley 118 without slipping during training or other exercises performed by the user 104 while wearing the body mounted device 110.

In some implementations, pulleys can be attached to external pieces of clothing or protective wear, such as kneepads 126. The kneepads 126 can be strapped around the knees of the user 104, and the pulley 122 can be attached to the kneepads 126 at a location that is adjacent to the knees, or otherwise near where the user 104 typically bends their knees. In some implementations, the pulleys 122 can be located above the knees or below the knees, or a pulley 122 can be located above a knee and a different pulley can be located below a different knee. By locating pulleys near the knees, resistance trajectories can be direct toward and/or away from the knees. For instance, a cable portion 124 can extend from the pulley 122 and attach to a wristband 140. The wristband 140 can be an adjustable wristband 140 that can be increased or decreased in diameter in order to secure the wristband 140 to the user 104 during training. In some implementations the wristband 140 can include Velcro portions that allow for adjustment of the wristband 140. In other implementations, the wristband 140 can include buttons, snaps, hooks, or any other mechanical device for securing the wristband 140 in a particular configuration while the wristband 140 is being worn by a user 104.

The wristband 140 can include a cable hook and/or tie ring. In some implementations, the tie ring can be connected between the cable hook and a body of the wristband 140, and the tie ring can be in a static position relative to the body of the wristband 140. Alternatively, the tie ring can surround the wristband 140 and move with the cable portion 124 as the user 104 moves during training. In some implementations, the cable hook can be a carabiner that can be attached to the cable portion 124 and the tie ring. The body mounted device 110 can be attached to at least two wristbands 140, each wristband 140 being located at each wrist of the user 104 in order to create some amount of resistance to a user 104 maneuvering a weapon 112. In some implementations, the body mounted device 110 can be attached to at least four wristbands 140, each wristband 140 being located at both wrists of the user 104 and near both ankles of the user 104.

In some implementations, the body mounted device 110 can include a computing device 130, which can include one or more processors and memory that stores instructions for tracking and analyzing performance of the user 104 during training and exercises. For instance, the computing device 130 can be connected to one or more sensors 132 that can provide signals in response to movements of the user 104 during training and exercises. In some implementations, the sensors 132 can be accelerometers capable of detecting motion in three dimensions. The sensors 132 can be attached directly or indirectly to the cables, the straps 108, and/or any other feature of the body mounted device 110. For instance, the sensors 132 can provide a signal in response to changes in tension of the cables, and the computing device 130 can process the signals to generate data related to the performance of the user 104. Such performance data can include an efficiency metric, an energy metric, a resistance metric, a distance metric, a coordination metric, and/or any other metric that can be used to quantify performance of a person during training or exercise.

Figure 2:
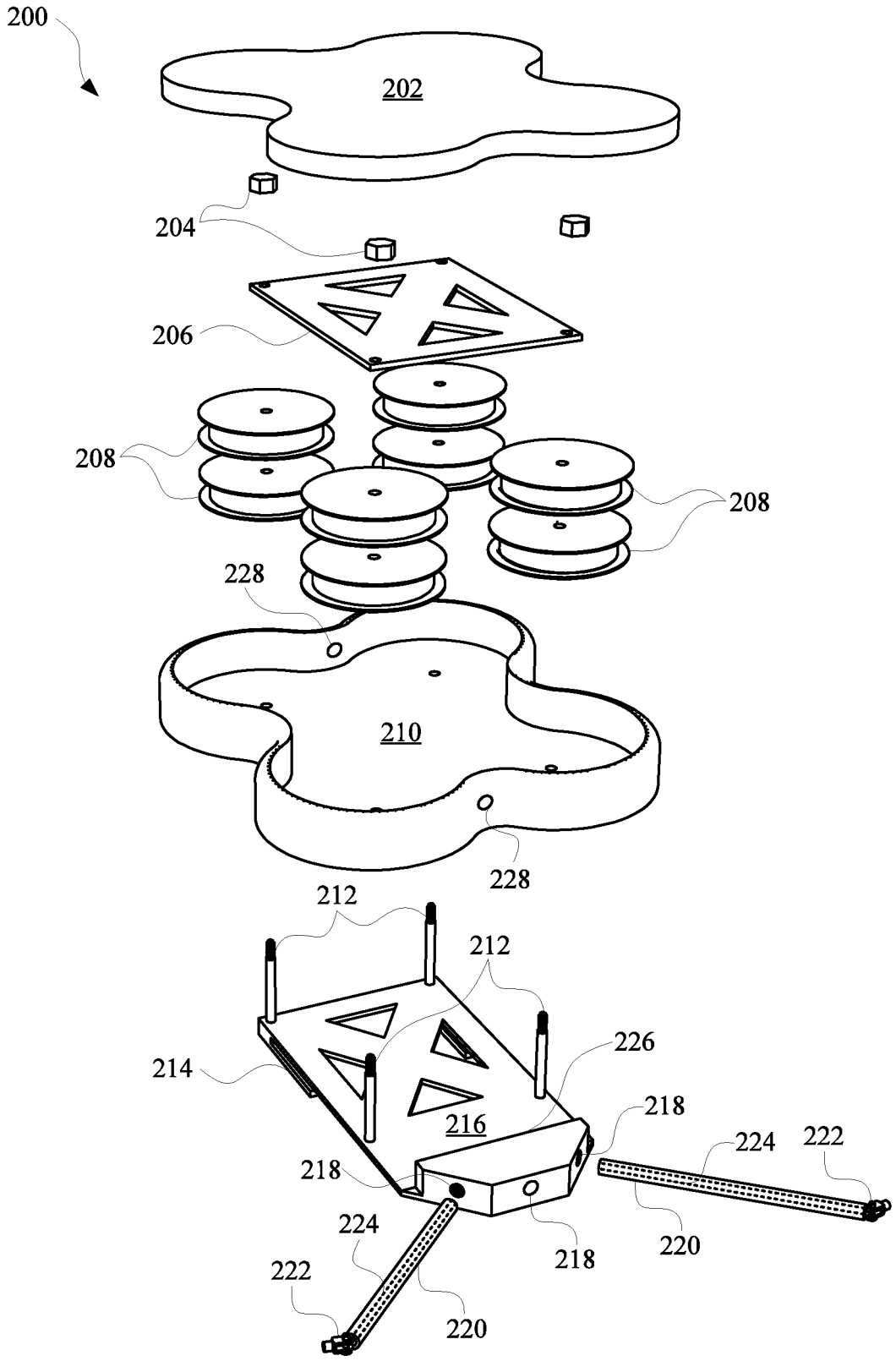
FIG. 2 illustrates an exploded view of a resistance assembly that can be used to provide three dimensions of resistance during exercise or other training.

FIG. 2 illustrates an exploded view of a resistance assembly 200 that can be used to provide three dimensions of resistance during exercise or other training. Specifically, the resistance assembly 200 can be included in a body mounted device for providing a source of cables that have adjustable tensions and can be attached near different portions of a user. The cables can be provided on one or more cable spools 208, which can be contained in a first housing portion 202 and a second housing portion 210. The cable spools 208 can include cable made from metal, non-metal, polymer, and/or any other material that can be formed into a cable. Each cable spool 208 can provide an adjustable amount of tension while a user is wearing the resistance assembly 200. The tensions of the cables can be adjusted at the cable spools 208, a cap portion 204 that secures the cable spools 208 in place, and/or any other feature that can be used to adjust tension of a cable. In some implementations, tension of the cables can be adjusted at a location outside the resistance assembly 200, for example, at a pulley about which a cable is arranged.

In some implementations, the resistance assembly 200 can include four or more cable spools 208, such that each limb of a user (each arm and each leg) can be directly or indirectly attached to a cable for providing some amount of resistance during exercise or other training. One or more cables from each cable spools 208 can be routed through an aperture 228 in the second housing portion 210. For instance, one or more cables can be routed from the cable spools 208 through an aperture 228 located near a clip 214. This cable can routed through the aperture 228, through a pulley near a shoulder or arm of the user, and ultimately attached proximate to the wrist of the user. As the user is maneuvering through their exercises, the cable spools 208 can rotate to release more cable from the cable spools 208 or pull cable back into the cable spools 208. In some implementations, one or more cables can be routed from the cable spools 208, through an aperture 228 located near the pipe mount 226, and through the pipe mount 226. The pipe mount 226 can extend toward a torso or feet of the user when worn by the user, thereby allowing the cable extending through the pipe mount 226 and pipes 220 to be attached to the torso, legs, feet, or other portion of the user. For instance, the user can wear knee braces that have pulleys for directing the movement of the cables. In some implementations, tension provided via the cable spools 208 can be non-uniform in order to improve brain plasticity of a user during an exercise or training. In other words, forcing the user to maintain control of their motion despite having non-uniform forces applied to their body can improve brain plasticity.

In some implementations, the resistance assembly 200 can include multiple at least partially overlapping plates that can be connected by joints 212, which can extend from a second plate 216. The joints 212 can include threaded distal ends and can extend through the second housing portion 210, the cable spools 208, and/or the first plate 206. In this way, the joints 212 can provide rigid support for the cable spools 208. The joints 212 can extend from the second plate 216, through the first plate 206, and the threaded distal ends can receive tension devices 204, such as bolts, or any other apparatus for connecting the first plate 206 to the second plate 216. In some implementations, the tension devices 204 can be arranged to compress or decompress the cable spools 208 in order to increase or decrease an amount of tension applied to the cable spools 208 as a user is exercising. In other implementations, the cable spools 208 can be individually adjusted using a spring or other feature of the cable spools 208.

The first plate 206 and/or the second plate 216 can include cut-out portions that allow air to pass through. In this way, a user wearing the resistance assembly 200 will not accrue condensation on their body as a result of lack of ventilation around their body. Furthermore, because the first plate 206 and the second plate 216 extend over opposing sides of the cable spools 208, each of the first plate 206 and the second plate 216 can protect the cable spools 208 from obstructions. Each clip 214, which can extend from a distal end of the second plate 216, and be arranged to allow the resistance assembly 200 to be attached to the user, such as, for example, at a belt or strap being worn by the user. Alternatively, the resistance assembly 200 can be incorporated into a body mounted device, such as the body mounted device 110 described with respect to FIG. 1. For instance, the resistance assembly 200 can be part of a backpack or vest that is strapped or otherwise worn by a user, and allows the pipes 220 to extend through such that cables can be attached directly or indirectly to the limbs of the user. Moreover, the cable portions described with respect to FIG. 1 can be supplied by the cable spools 208 of the resistance assembly 200 described in FIG. 2. Furthermore, the resistance assembly 200 can be supported by a wearable vest, such as a MOLLE vest.

The resistance assembly 200 can be attached to a computing device that is in communication with one or more sensors for monitoring a performance of a user that is wearing the resistance assembly. For instance, in some implementations, the computing device can measure, monitor, and/or report the performance of the user during exercise, training, and/or rehabilitation. The computing device can use signals from the one or more sensors as feedback, which can provide a basis for modifying the operations of the resistance assembly. For example, the computing device can use motors, solenoids, and/or other devices to modify a resistance or tension of the cables and/or cable spools of the resistance assembly. In this way, the computing device is able to dynamically adjust the resistance assembly in order to improve the performance of the user wearing the resistance assembly.

In some implementations, the sensors in communication with the computing device can include a heart rate monitor, a temperature sensor, a pedometer, a camera, and/or any other sensor capable of monitoring a user. Furthermore, the sensor can measure an interaction with the resistance assembly by, for example, using a position sensor and/or a torque sensor that measure a frequency of movements, torque of certain movements, and/or any other characteristic of movement. The position sensor and/or the torque sensor can be attached to the cable spools, pulleys, cables, and/or any other feature of the resistance assembly 200 that can be responsive to user movements.

The computing device can modify a resistance or a tension of one or more cables of the resistance assembly 200 during an activity being performed by the user. For instance, while a user is running with the resistance assembly 200, a sensor (e.g., a pedometer or torque sensor) can monitor the progress of the user and/or the effort exerted by the user. Such metrics can be based on a frequency of steps of the user and/or a speed at which the user is taking steps. The computing device use the metrics to adjust the resistance or the tension of the cables. For instance, when a metric (e.g., frequency, speed) corresponding to the performance of the user has reached a threshold, the computing device can cause the cables to increase or decrease in tension. The changes in tension can be effectuated by an actuator, solenoid, servo motor, and/or any other device capable of changing a resistance and/or tension of a cable. As a result, the user would have to exert more or less effort while running in order to maintain their speed, or otherwise perform consistently. In this way, the computing device is able to simulate scenarios where the body may be stressed while running.

The computing device can modify resistance and/or tension differently at different portions of the resistance assembly 200. Such modifications can be beneficial during training that involves applying stress to separate areas of the body. For instance, a user may undergo training that involves crawling with a weapon. During the training, one or more sensors can monitor the movements of the user and the computing device can use signals from the sensors to vary the tension on certain cables or pulleys as the user is crawling. For example, a sensor can be used to determine how much force, on average, is being applied by each arm and leg of the user during the training. If the sensor indicates that a difference between forces applied by the right arm and left arm, or right leg and left leg, have reached a difference threshold, the computing device can cause an increase or decrease in tension of cables or pulleys connected to the right side or the left side of the body of the user. In this way, the user will be encouraged to evenly exert force from both sides of the body during training exercises. Alternatively, the computing device can cause an increase or decrease in tension of cables or pulleys connected to the arms or the legs, to ensure that the user is adequately straining their upper body or lower body during training. Such changes in tension at the cables or pulleys can be effectuated by electrical signals transmitted from the computing device to actuators, solenoids, servos, or other devices connected to the cables or pulleys.

In some implementations, the resistance assembly 200 can include a pipe mount 226 arranged to receive one or more pipes 220 through which one or more cables from the cable spools 208 can traverse. For instance, each pipe 220 can be flexible or rigid, and can include a hollow portion 224 that extends through an entire length of the pipes 220. An end of each pipe 220 can optionally include a swivel feature 222 that can allow the cable to be pulled from the cable spools 208 at different directions with minimal changes in friction at the pipe 220. In other words, the swivel feature 222 can act as a ball joint that includes a channel through which the cable can move in and out of In some implementations, the pipe mount 226 can include at least two cable paths 218 that traverse the pipe mount 226. The cable paths 218 can include threaded portions that allow the pipes 220 to be screwed into and secured to the pipe mount 226. In some implementations, the pipe mount 226 can be formed to the pipes 220 such that the material of the pipes 220 is shared with the material of the pipe mount 226. In some implementations, the pipe mount 226 can include a cable path 218 that extend perpendicular to the joints 212 and/or parallel to a length of the second plate 216. In this way, a cable from the cable spools 208 can traverse the cable path and extend toward the head or feet of the user (e.g., approximately 90 degrees or 270 degrees relative to the ground on which the user may be exercising).

Figure 3A:
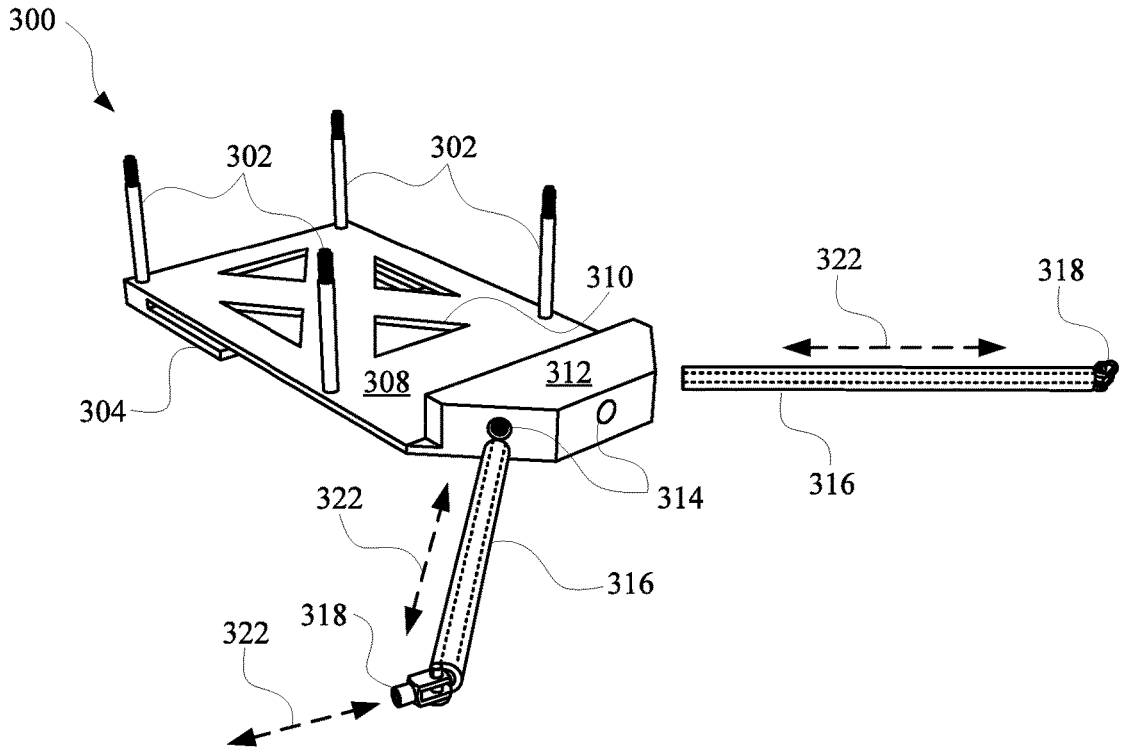
FIGS. 3A and 3B illustrate exploded views of a plate or bracket for a body mounted device that can contain and direct cables for providing resistance when worn during exercises and training.
Figure 3B:
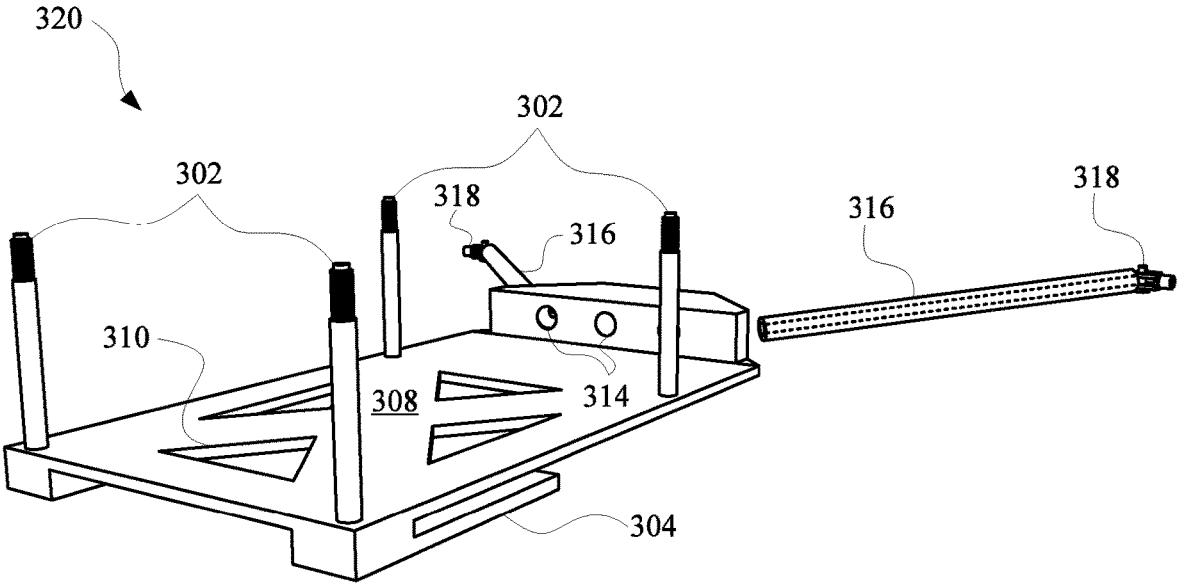

FIGS. 3A and 3B illustrate exploded views 300 and 320 of a plate 308 or bracket for a body mounted device that can contain and direct cables for providing resistance when worn during exercises and training. The plate 308 can be employed as a mount for multiple cable spools and a source through which the cables can be pulled and retracted. In order to mount the multiple cable spools, the plate 308 can include multiple joints 302, which can penetrate apertures of the cable spools and allow each cable spool to rotate about each joint 302. The plate 308 can further include a clip 304 for connecting the plate 308 to a user. For instance, the clip 304 can be connected to a shirt, a belt, a strap, a backpack, or any other clothing item that can be worn by the user. The clip 304 can be located at a distal end of the plate 308 that is opposite a pipe mount 312 of the plate 308.

The pipe mount 312 can include multiple apertures 314 from which pipes 316 can extend to provide pathways for the cables to move. In some implementations, there can be a single aperture 314 at a surface of the pipe mount 312 that is facing the joints 302 and multiple apertures that extend from the single aperture 314 in an opposite direction. In this way, there can be a single opening in which the cables from the cable spools can enter. The apertures 314 at the end of the pipe mount 312 facing away from the joints 302 can include threads for connecting the pipes 316 to the pipe mount 312. Each pipe 316 can include a hollow channel through which the cables can move in and out of, according to direction 322. In some implementations, the pipes 316 can include an open end, while in other implementations the pipes 316 can include pivoting ends 318 that can change a direction of an opening of the pipes 316. For instance, the pivoting ends 318 can simultaneously face away from the plate 308 or towards the plate 308. In other implementations, the pipes 316 can be flexible in order to provide additional tension when the user is wearing the plate 308 and pulling on the cables.

In some implementations, the plate 308 can include apertures 310 for providing flexibility and breathability to the plate 308. Furthermore, the apertures 310 can allow a user to see the cables provided from the cable spools, thereby allowing the user diagnose any issues that may occur with the cables. The apertures 310 also reduce the weight of the plate 308, making it easier to carry during exercises and training.

Figure 4:
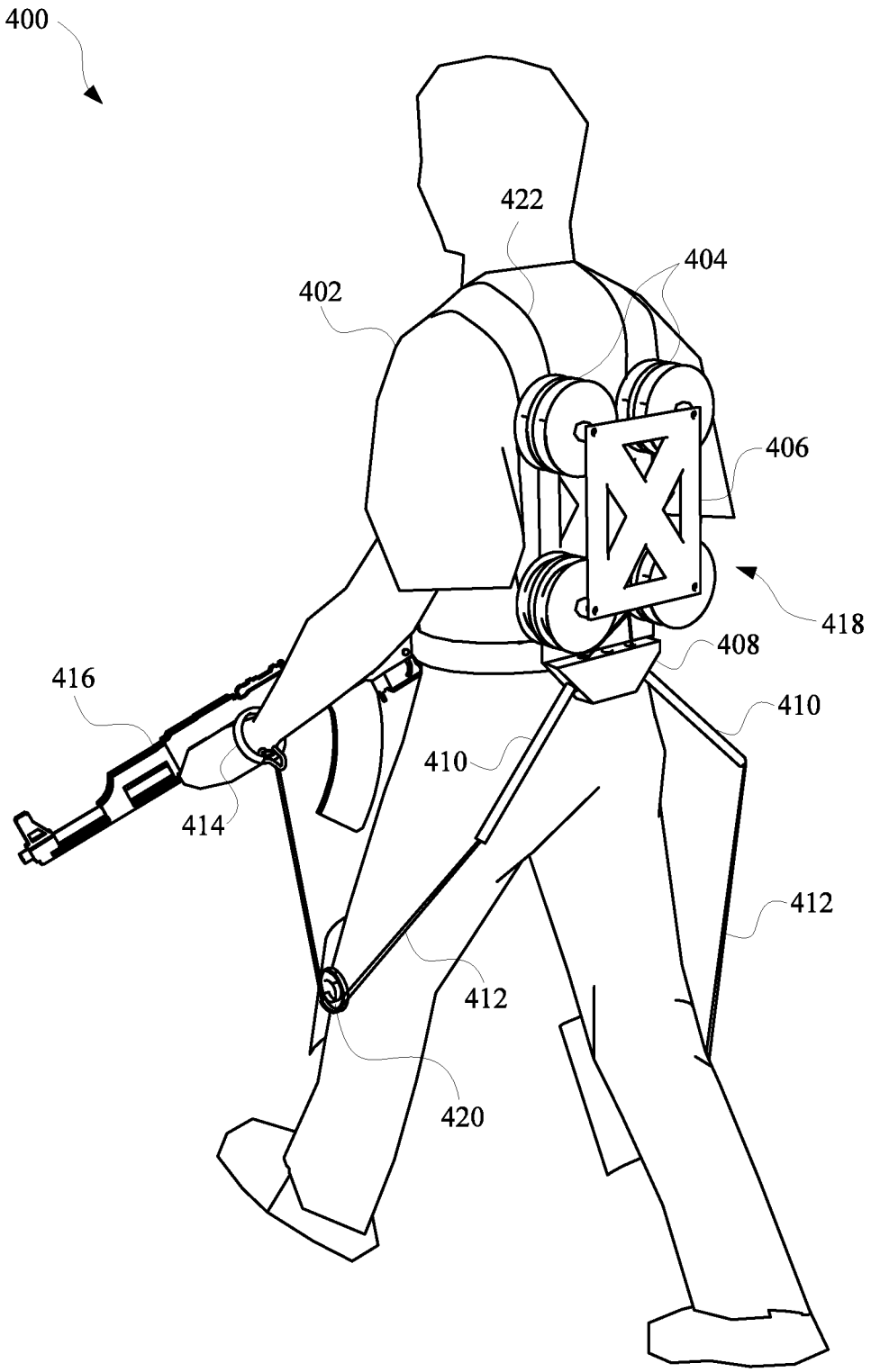
FIG. 4 illustrates a perspective view of a user wearing a resistance assembly as discussed herein.

FIG. 4 illustrates a perspective view 400 of a user 402 wearing a resistance assembly 418 as discussed herein. The resistance assembly 418 can supply cables 412 to different appendages (e.g., arms, legs, etc.) of the user 402 in order to provide tension to those appendages during exercises and training. The resistance assembly 418 can supply the cables 412 from cable spools 404 attached to the resistance assembly 418. The cables 412 can extend under a plate 406 of the resistance assembly 418 and through a pipe mount 408 of the resistance assembly 418. Thereafter, the cables 412 can extend through pipes 410, which can be attached to the pipe mount 408 and direct the cables 412 in different directions. For instance, when the resistance assembly 418 is being worn by the user 402, each pipe 410 can extend toward a foot, a knee, and/or a thigh of the user 402. In this way, the cables 412 moving through the pipes 410 will not interfere with any other areas of the user 402 beyond where the cables 410 are connected.

In some implementations, the cables 412 can be routed around pulleys 420, which can be attached at different locations of the user 402. For instance, a pulley 420 can be attached to a knee strap such that a cable 412 can extend toward the knee and up to the wrist of the user 402, thereby applying tension at both the knee and wrist of the user 402. Applying tension at multiple locations of the user 402 can improve exercise and training of, for example, a soldier that typically must deal with various terrains and obstacles. If a soldier needs to train with a weapon 416, a cable 412 from the resistance assembly 418 can be routed through a pipe 410, around a pulley 420, and attached to a wristband 414. In this way, as the user 402 is moving with their weapon 416, the wrist and knee of the user 402 will experience some amount of tension. In some implementations, the amount of tension of cables 412 moving through each pipe 410 can be adjusted. For instance, a cable 412 moving through a pipe 410 at the left side of the user 402 can have a different amount of tension than a cable 412 moving through a pipe 410 at the right side of the user 402.

The user 402 can wear the resistance assembly 418 by attaching the resistance assembly 418 to a backpack 422 using clips that extend from a plate of the resistance assembly 418. In this way, the resistance assembly 418 acts as a portable wearable apparatus that can provide tension in three dimensions. For instance, when the user 402 is climbing stairs while wearing the resistance assembly 418 and holding the weapon 416, tension will be applied to each knee as the user 402 lifts each leg to go up the stairs. Additionally, as the user 402 lifts the weapon 416 up each stair, the wrist of the user 402 will receive consistent tension from the cable 412 that is wrapped around the pulley 420.

Although the resistance assembly 418 is illustrated as guiding the cables 412 below the torso of the user 402, in some implementations the cables can also be directed above the torso of the user 402. For instance, the resistance assembly 418 can include a hooks on the backpack 422 that direct the cables 412 over the shoulders of the user 402 and connect to the chest and/or wrists of the user 402 in order to apply tension to the chest and/or wrists during exercises. In other implementations, the resistance assembly 418 can include a pipe mount 408 that extends toward the feet of the user 402 and a separate pipe mount that faces toward the head of the user 402. In this way, cables can be directed via pipes over the shoulders of the user 402 simultaneous to cables 412 being directed toward the legs of the user 402. Each cable can be provided by a separate spool 404 thereby allowing each appendage of the user 402 to be assigned a separate amount of tension.

In some implementations, the resistance assembly 418 can include a computing device that is connected behind the plate 406 for tracking the performance of the user 402 while the user 402 is wearing the resistance assembly 418. For instance, the computing device can be connected to sensors that can measure an amount of pulling force being applied by each cable 412. The data from the sensors can be processed and recorded in order to compare past performances of the user 402, and/or compare performances of different users. In some implementations, the computing device can control the amount of tension applied to the cables. For instance, during an exercise, the computing device can cause the cable spools 404 to increase or decrease tension in order to provide variability during the exercise.

Figure 5:
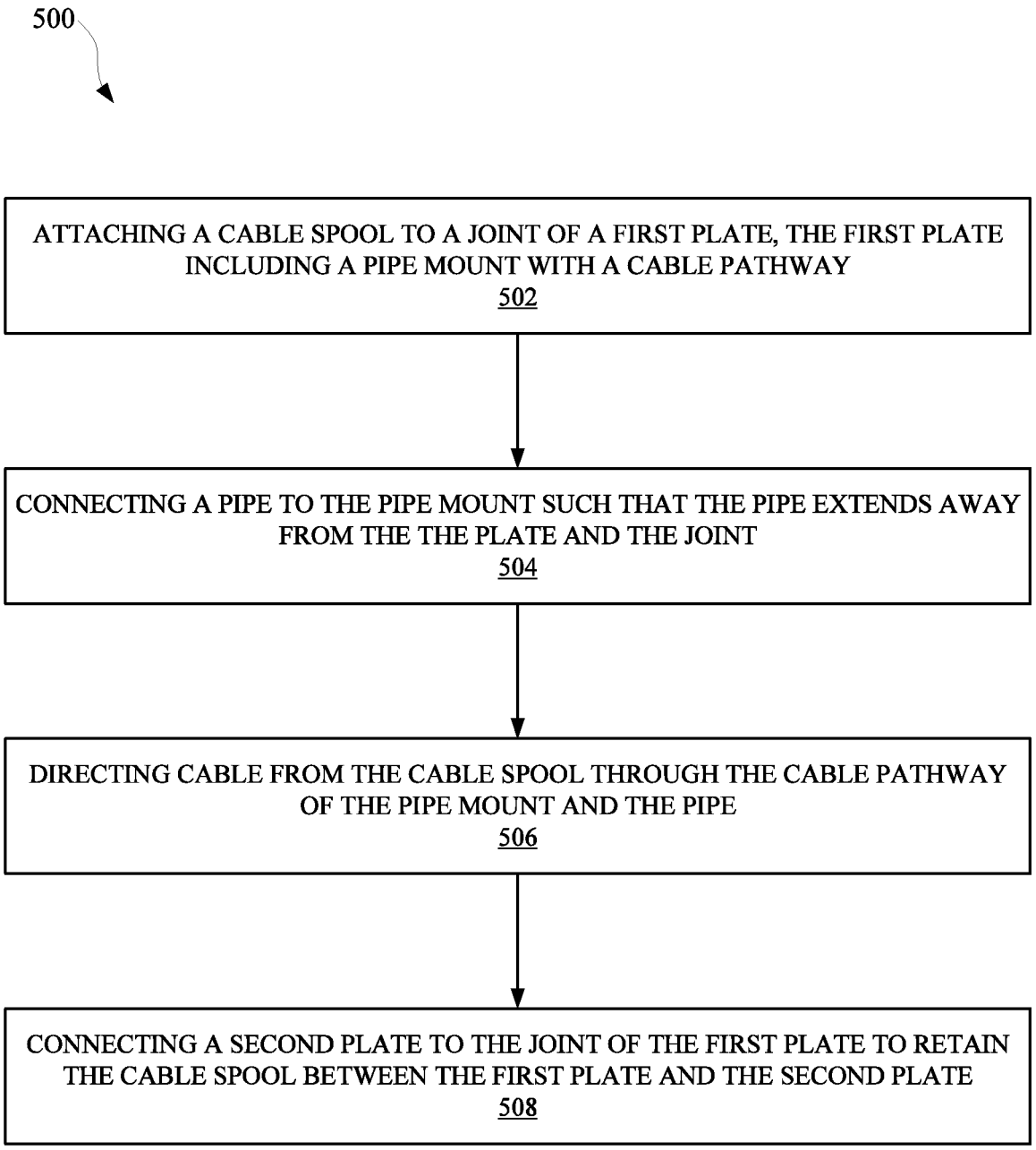
FIG. 5 illustrates a method for manufacturing a resistance assembly according to some embodiments discussed herein.

FIG. 5 illustrates a method 500 for manufacturing a resistance assembly according to some embodiments discussed herein. The method 500 can be performed by one or more computing devices, or any other apparatuses capable of manufacturing an exercise device. The method 500 can include a block 502 of attaching a cable spool to a joint of a first plate, the first plate including a pipe mount with a cable pathway. The cable spool can be a circular spool of cable with an aperture through which the joint of the first plate can extend through. The first plate can be made from a light, rigid material such as aluminum, plastic, and/or any other material that can be formed into a wearable product. The pipe mount can also be made from a rigid material that is capable of being formed with cable pathways. The cable pathways can be formed into the pipe mount in multiple directions, through opposing surfaces of the pipe mount. For instance, multiple cable pathways can be connected to openings in a common surface of the pipe mount and terminate at different surfaces of the pipe mount.

The method 500 can further include a block 504 of connecting a pipe to the pipe mount such that the pipe extends away from the plate and the joint. The pipe can be a flexible or rigid, hollow tube that can extend from the pipe mount and away from the first plate. The pipe can be screwed into the pipe mount, formed to the pipe mount, welded to the pipe mount, or otherwise attached to the pipe mount so that a uniform cavity can extend through the pipe and the cable pathway. In some implementations, multiple pipes can be attached to the pipe mount such that each pipe extends from the pipe mount in different directions. This configuration allows for cables to be extended from the cable spools in different directions, thereby allowing tension vectors created by the cables to affect a user while wearing the first plate during an exercise.

The method 500 can further include a block 506 of directing cable from the cable spool through the cable pathway of the pipe mount and the pipe. Directing cable from the cable spools through the cable pathway can include unwinding the cable from a cable spool, pushing the cable through an opening in the pipe mount, and pulling the cable out of the pipe connected to the pipe mount. In some implementations, multiple cables are pulled from the cable spools, through the pipe mount, and through the pipes that are connected to the pipe mount.

The method 500 can further include a block 508 of connecting a second plate of the joint of the first plate to retain the cable spool between the first plate and the second plate. The second plate can extend parallel over the first plate and can optionally abut the pipe mount. In some implementations, each of the first plate and the second plate can include openings that reduce the weight of the plates and/or allow air to move through the plates. The cable from the spools can move between the plates during exercises performed by the user thereby protecting the cables and reducing the amount of interference between the environment and the cables. The cables can be extended around pulleys that can be attached at different locations on the appendages of the user. For instance, the cables can be attached to the wrists of the user while also being directed around pulleys that are attached to the knees of the user. The cable spools can provide an amount of tension that requires the user to exert effort when moving their wrists away from their knees. In some implementations, the cable spools can be adjusted to so that different amounts of tension are applied to the wrists of the user.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope

I claim:

1. A method for providing a wearable apparatus, the method comprising:

attaching a cable spool to a joint of a plate, the plate including a pipe mount with a cable pathway;

connecting a pipe to the pipe mount such that the pipe extends away from the plate and the joint;

directing cable from the cable spool through the cable pathway of the pipe mount and the pipe; and attaching the plate to one or more straps using clips that extend from the plate.

2. The method of claim 1, further comprising: extending the joint through an aperture of the cable spool to provide an axis of rotation for the cable spool.

3. The method of claim 1, further comprising:

connecting multiple pipes to the pipe mount, wherein the multiple pipes extend from the pipe mount in different directions.

4. The method of claim 1, further comprising: providing the plate that includes the pipe mount, wherein the pipe mount includes multiple cable pathways, and each cable pathway includes an opening located at a surface of the pipe mount.

5. The method of claim 1, further comprising: providing, via the cable spool, an amount of tension on the cable in a direction that pulls the cable back through the pipe.

6. The method of claim 1, further comprising:

attaching another cable spool to the plate, wherein the cable spool and the other cable spool provide separately adjustable tension.

7. A system, comprising:

a plate that includes a pipe mount from which a pipe extends and a cable pathway through which a cable passes;

a cable spool that supplies the cable that passes from the cable spool through the pipe mount and the pipe;

a pulley for redirecting the cable from the pipe in a trajectory that is different than a direction in which the pipe extends; and a strap that supports the plate when the strap is worn by a user, wherein the pulley and the cable are configured to attach at separate locations on the user to create tension at the separate locations, wherein the plate further includes a clip that extends over a side of the plate that opposes the cable spool.

8. The system of claim 7, further comprising:

a separate plate that at least partially extends over the cable spool and the cable.

9. The system of claim 7, wherein the cable spool is configured to provide an adjustable amount of tension to the separate locations on the user.

10. The system of claim 7, wherein an opening of the pipe faces away from the plate and towards the pulley.

11. The system of claim 7, further comprising:

multiple cable spools configured to provide multiple cables through the pipe mount, wherein each of the multiple cables spools includes separately adjustable tension; and a vest configured to be worn by the user and support the multiple cable spools and the plate.

* * * * *